US009341209B2

(12) United States Patent
Hall et al.

(10) Patent No.: US 9,341,209 B2
(45) Date of Patent: May 17, 2016

(54) SQUEEGEE RETAINER CLIP

(75) Inventors: Aaron T. Hall, Carey, OH (US); Kale R. Johnson, Minneapolis, MN (US)

(73) Assignee: Nilfisk, Inc., Plymouth, MN (US)

( * ) Notice: Subject to any disclaimer, the term of this patent is extended or adjusted under 35 U.S.C. 154(b) by 0 days.

(21) Appl. No.: 14/115,737

(22) PCT Filed: May 6, 2011

(86) PCT No.: PCT/US2011/035590

§ 371 (c)(1),
(2), (4) Date: Nov. 5, 2013

(87) PCT Pub. No.: WO2012/154161

PCT Pub. Date: Nov. 15, 2012

(65) Prior Publication Data

US 2014/0140762 A1 May 22, 2014

(51) Int. Cl.
*F16B 17/00* (2006.01)
*A47L 11/40* (2006.01)

(52) U.S. Cl.
CPC ..... *F16B 17/00* (2013.01); *A47L 11/4044* (2013.01); *Y10T 403/7075* (2015.01)

(58) Field of Classification Search
CPC ..... B63H 20/06; B63H 20/10; B63H 20/106; H01Q 1/084; Y10T 24/44709; Y10T 403/459; Y10T 74/20636; Y10T 24/44769; Y10T 24/44974; Y10T 403/7152; Y10T 403/7176; B25B 5/101; B25B 5/16; B25H 3/006; E04C 5/163; E04C 5/20
USPC ..... 24/514, 3.12, 326, 538, 545, 569
See application file for complete search history.

(56) References Cited

U.S. PATENT DOCUMENTS

| | | | | |
|---|---|---|---|---|
| 398,508 | A * | 2/1889 | Hatch | 248/286.1 |
| 1,331,851 | A * | 2/1920 | Ouzoun-Boghossian | 294/99.2 |
| 1,928,626 | A | 10/1933 | Lesage | |
| 2,263,554 | A | 11/1941 | Brach | |
| 2,452,406 | A * | 10/1948 | Volkery et al. | 403/391 |
| 2,574,007 | A | 11/1951 | Anderson | |
| 2,844,981 | A * | 7/1958 | Steine | 248/534 |

(Continued)

FOREIGN PATENT DOCUMENTS

WO WO-2012154161 A1 11/2012

OTHER PUBLICATIONS

"International Application Serial No. PCT/US2011/035590, International Search Report and Written Opinion Aug. 2, 2011", 8 pgs.

(Continued)

*Primary Examiner* — Robert J Sandy
*Assistant Examiner* — David Upchurch
(74) *Attorney, Agent, or Firm* — Schwegman Lundberg & Woessner, P.A.

(57) ABSTRACT

A retainer clip for a squeegee assembly comprises top and bottom clip members each having an interior surface and an exterior surface. The interior surface of the top clip member includes a first channel portion adjacent to a first end and a first interlocking feature adjacent to a second end. The interior surface of the bottom clip member includes a second channel portion adjacent to a first end and a second interlocking feature adjacent to a second end. Mating the first interlocking feature with the second interlocking feature positions the first channel portion adjacent to the second channel portion to form a pin receiving channel.

16 Claims, 12 Drawing Sheets

(56) References Cited

U.S. PATENT DOCUMENTS

| | | | | |
|---|---|---|---|---|
| 3,537,150 | A * | 11/1970 | Emberson | 403/344 |
| 4,617,775 | A | 10/1986 | Padrun | |
| 4,895,329 | A * | 1/1990 | Sloan | 248/229.16 |
| 6,112,494 | A * | 9/2000 | Hardy et al. | 52/685 |
| 6,397,429 | B1 | 6/2002 | Legatt et al. | |
| 6,513,772 | B2 * | 2/2003 | Gary et al. | 248/231.91 |
| 6,519,808 | B2 | 2/2003 | Legatt et al. | |
| 6,557,207 | B2 | 5/2003 | Stuchlik | |
| 7,178,777 | B1 | 2/2007 | Banker | |
| 7,254,867 | B2 | 8/2007 | Legatt et al. | |
| 8,464,987 | B1 * | 6/2013 | DeCesare et al. | 248/74.5 |
| 2002/0000027 | A1 * | 1/2002 | Andersen et al. | 24/535 |
| 2003/0115726 | A1 * | 6/2003 | Liao | 24/569 |

OTHER PUBLICATIONS

"International Application Serial No. PCT/US2011/035590, International Preliminary Report on Patentability mailed Nov. 21, 2013", 7 pgs.

* cited by examiner

SQUEEGEE RETAINER CLIP

CLAIM OF PRIORITY

This application is a U.S. National Stage Application filed under 35 U.S.C. §371 of International Application Serial No. PCT/US2011/035590, filed May 6, 2011, and published on Nov. 15, 2012 as WO 2012/154161 A1, which application and publication is herein incorporated by reference in its entirety.

BACKGROUND OF THE INVENTION

The present invention relates generally to a cleaning apparatus. More specifically, the present invention relates to a retainer clip for a squeegee assembly that allows the squeegee assembly to detach or "break away" from the cleaning apparatus upon contact with an obstruction so as to prevent damage to the squeegee or to its mounting structure.

Industrial and commercial floors are cleaned on a regular basis for aesthetic and sanitary purposes. There are many types of industrial and commercial floors ranging from hard surfaces such as concrete, terrazzo, wood, and the like, which can be found in factories, schools, hospitals, and the like, to softer surfaces such as carpeted floors found in restaurants and offices. Different types of floor cleaning equipment such as scrubbers, sweepers, and extractors, have been developed to properly clean and maintain these different floor surfaces.

A typical scrubber is a walk-behind or drivable, self-propelled, wet process machine that applies a liquid cleaning solution from an onboard cleaning solution tank onto the floor through nozzles fixed to a forward portion of the scrubber. Rotating brushes forming part of the scrubber rearward of the nozzles agitate the solution to loosen dirt and grime adhering to the floor. The dirt and grime become suspended in the solution which is collected by a vacuum squeegee fixed to a rearward portion of the scrubber and deposited into an onboard recovery tank.

Scrubbers are very effective for cleaning hard surfaces. Unfortunately, debris on the floor can clog the vacuum squeegee, and thus, the floor should be swept prior to using the scrubber. Therefore, sweepers are commonly used to sweep a floor prior to using a scrubber. A typical sweeper is a self-propelled, walk-behind or drivable dry process machine that picks debris off a hard or soft floor surface without the use of liquids. The typical sweeper has rotating brushes which sweep debris into a hopper or "catch bin."

Combination sweeper-scrubbers have also been developed that provide the sweeping and scrubbing functionalities in a single unit.

In a typical squeegee assembly used to collect dirty solution from a floor surface, the front and rear blades of the squeegee are always in contact with the floor surface so that any liquid on the floor surface is exposed to, picked up, and carried by airflow in the squeegee assembly. The rear blade in particular is provided with sufficient downward force to bend the blade outward so that only one edge of the blade engages the floor surface. Exemplary squeegee assemblies are disclosed in U.S. Pat. No. 7,254,867, U.S. Pat. No. 6,557,207, U.S. Pat. No. 6,397,429, and U.S. Pat. No. 6,519,808.

FIG. 1 is a perspective view of one exemplary squeegee assembly 10 of the prior art. As illustrated in FIG. 1, the squeegee assembly 10 generally includes a front flexible blade 12, a rear flexible blade 14, a support 16, and a suction tube 18 structured for connection to a vacuum source. The front and rear flexible blades 12 and 14 extend from a bottom side of the support 16, and are structured and designed to contact a floor surface. An upper end 20 of the suction tube 18 extends from a top side 22 of the support 16. Also extending from the top side 22 of the support 16 are connection means 24 for connecting the squeegee assembly 10 to a surface cleaning machine.

In operation, the squeegee assembly 10 may be coupled to a surface cleaning machine by the connection means 24 such that the front blade 12 is oriented with respect to the forward movement of the surface cleaning machine. Solution tends to pass through openings or slots in the front blade 12 or underneath the front blade 12 and is not directed to travel past the ends of the squeegee assembly.

The connection means 24 is typically a threaded fastener type mechanism having a vertical post (not shown) that slides into an open-ended channel 26 of a mounting plate 27 on the back end of the surface cleaning machine as more clearly illustrated in FIG. 2. When the vertical post is inserted into the open-ended channel 26, the connection means 24 is tightened so as to "sandwich" the open-ended channel 26 between the top side 22 of the squeegee assembly support 16 and the connection means 24.

FIG. 3 illustrates an alternative connection means in the form of a locking lever 28. The locking lever 28 may include a vertical post portion that is structured to be received within an open-ended channel 29 as described above with regard to FIG. 2.

Although numerous connection means exist for connecting a squeegee assembly to a surface cleaning machine, such prior art designs do not reliably allow the squeegee assembly to detach or "break away" from the machine to which it is attached upon contact with an obstruction. As appreciated by those skilled in the art, it is not uncommon for a squeegee assembly to "hit" fixed objects such as doorways, posts, or the like during operation. However, contact with such fixed objects or obstructions risks damage to the squeegee assembly and/or surface cleaning machine if the squeegee assembly is unable to detach upon application of a sufficient amount of force.

Thus, there is a need for an improved connection means for releasably connecting a squeegee assembly to a surface cleaning machine.

SUMMARY OF THE INVENTION

The present invention addresses the foregoing needs by providing a retainer clip for a squeegee assembly that comprises top and bottom clip members each having an interior surface and an exterior surface. The interior surface of the top clip member includes a first channel portion adjacent to a first end and a first interlocking feature adjacent to a second end. The interior surface of the bottom clip member includes a second channel portion adjacent to a first end and a second interlocking feature adjacent to a second end. Mating the first interlocking feature with the second interlocking feature positions the first channel portion adjacent to the second channel portion to form a pin receiving channel.

DETAILED DESCRIPTION OF THE INVENTION

Generally speaking, the present invention relates to a retainer clip for a squeegee assembly that allows the squeegee assembly to detach or "break away" from the cleaning apparatus to which it is attached upon contact with an obstruction so as to prevent damage to the squeegee assembly. As will be appreciated by those skilled in the art, squeegee retainer clips in accordance with the present invention may be used to releasably attach squeegee assemblies to any floor cleaning system that requires the use of a squeegee for liquid pick-up without departing from the intended scope of the present invention. However, for purposes of example and not limitation, the squeegee retainer clips of the present invention will be described as applied to a combination sweeper-scrubber system.

Figure 1:
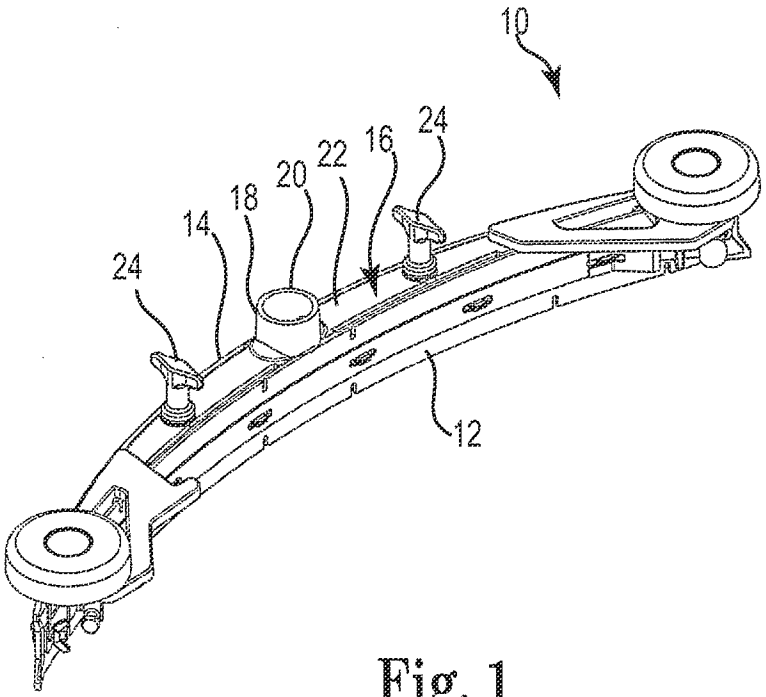
Fig. 1 PRIOR ART
FIG. 1 is a perspective view of one exemplary squeegee assembly of the prior art.
Figure 2:
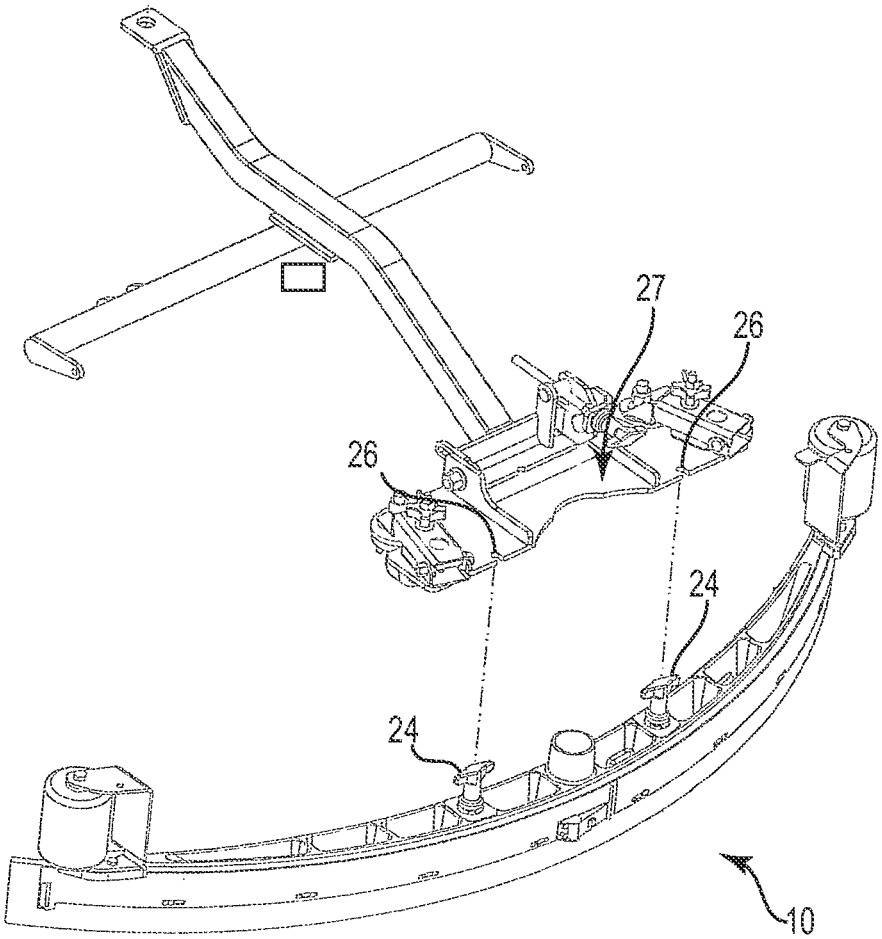
Fig. 2 PRIOR ART
FIG. 2 is one exemplary prior art connection means for connecting the squeegee assembly of FIG. 1 to a surface cleaning machine.
Figure 3:
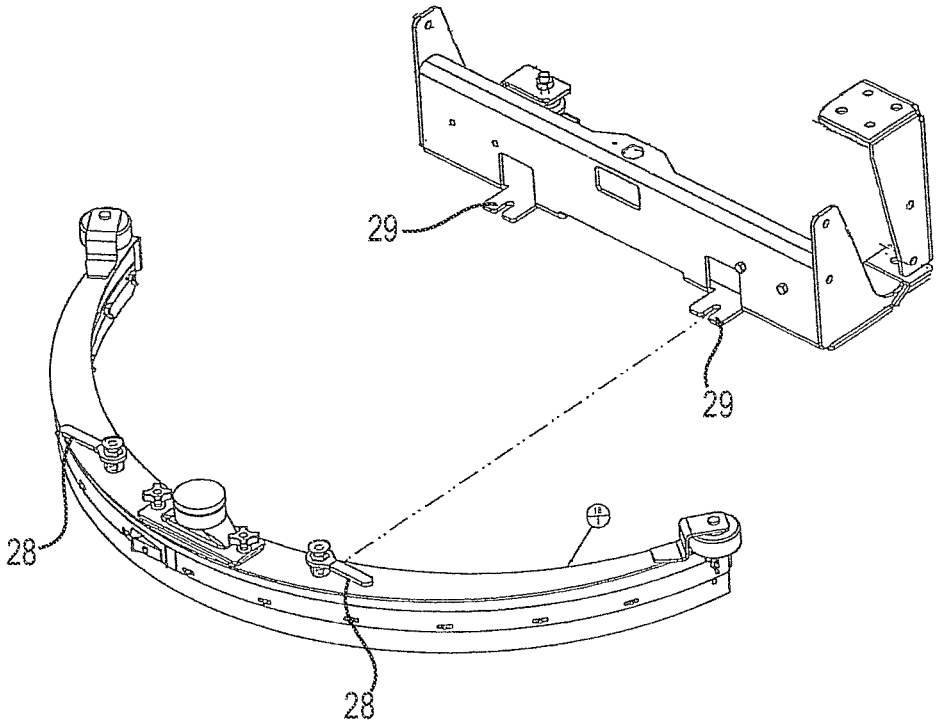
Fig. 3 PRIOR ART
FIG. 3 is a diagram illustrating another exemplary prior art connection means for connecting the squeegee assembly of FIG. 1 to a surface cleaning machine.
Figure 4:
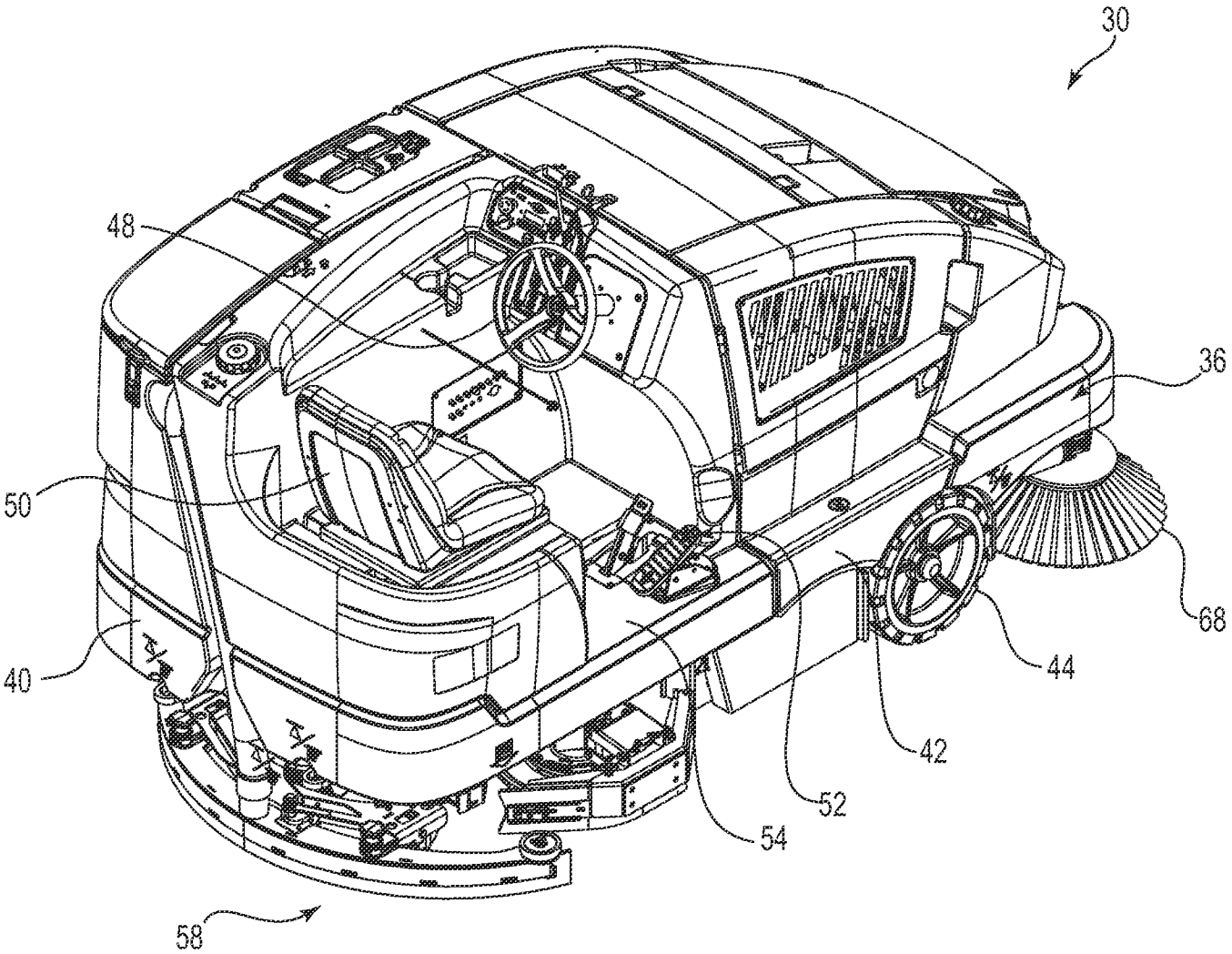
FIG. 4 is a top perspective view of one exemplary sweeper-scrubber that utilizes squeegee retainer clips in accordance with the present invention to couple a squeegee assembly to a squeegee support bracket.
Figure 5:
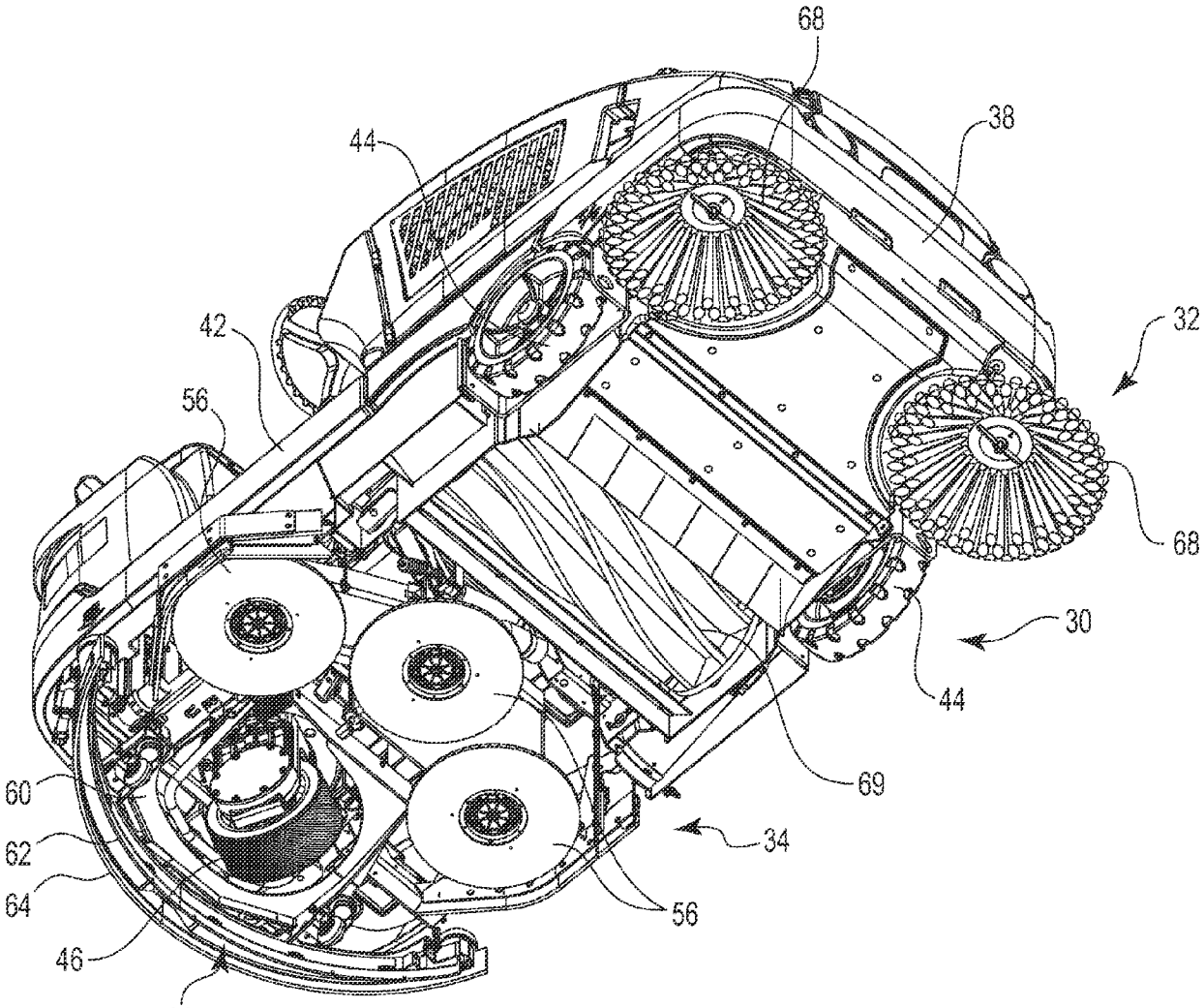
FIG. 5 is a bottom perspective view of the exemplary sweeper-scrubber of FIG. 4.

FIGS. 4 and 5 are top and bottom perspective views, respectively, of one exemplary sweeper-scrubber 30 that utilizes squeegee retainer clips in accordance with the present invention. As illustrated in FIGS. 4 and 5, the sweeper-scrubber 30 includes a sweeper system 32 for sweeping a floor surface and a scrubber system 34 for scrubbing the floor surface. Thus, as will be discussed in further detail below, the sweeper-scrubber 30 is operable to sweep dirt and debris from the floor surface and then apply a liquid cleaning solution from an onboard cleaning solution tank onto the floor being cleaned, agitate the cleaning solution, and use suction to draw the cleaning solution into an onboard recovery tank.

Providing a floor cleaning system having both a sweeper system 32 and a scrubber system 34 allows the operator to perform both "dry" and "wet" cleaning with the same system. As will be appreciated by those skilled in the art, the sweeping and scrubbing modes may be operated either separately or simultaneously depending upon the type of cleaning required.

As further illustrated in FIGS. 4 and 5, the sweeper-scrubber 30 includes a chassis 36 having a forward end 38 and a rearward end 40 joined by sides 42. The chassis 36 is supported by floor engaging front wheels 44 and a rear steerable wheel 46. The rear steerable wheel 46 is operatively connected to a steering wheel 48 through the chassis 36.

A driver seat 50 is supported by the chassis 36 rearward of the steering wheel 48 for use by an operator operating the sweeper-scrubber 30. The operator sits on the driver seat 50 to operate the steering wheel 48 and foot operated control pedals 52, such as a brake and accelerator supported above the chassis top surface 54.

In operation, liquid cleaning solution is applied from an onboard cleaning solution tank onto the floor being cleaned. The cleaning solution can be gravity fed or alternatively pumped out of the cleaning solution tank onto the floor. The cleaning solution applied onto the floor is then agitated by a plurality of ground engaging agitation brushes 56 extending from a bottom surface of the chassis 36. As illustrated in FIGS. 4 and 5, the ground engaging agitation brushes 56 have parallel axes of rotation that are substantially perpendicular to the floor surface. The ground engaging agitation brushes 56 are rotatably driven by a suitable motor, and agitate the cleaning solution sprayed onto the floor to dislodge dirt and grime adhered thereto. In addition to the agitation brushes 56, the scrubber system 34 further includes a floor engaging vacuum squeegee assembly 58 disposed proximal the chassis rearward end 40. The agitated cleaning solution and suspended dirt and grime are drawn off the floor through the squeegee assembly 58 and into the recovery tank for disposal.

The squeegee assembly 58 is coupled to a squeegee support bracket 60 pivotally fixed relative to the chassis 36, and can be moved between an operating position and a stored position (when not in use). The squeegee assembly 58 is operable to dry the floor surface being cleaned by the sweeper-scrubber 30 and includes a forward arcuate squeegee blade 62 nested in a rearward arcuate squeegee blade 64. The nested squeegee blades 62 and 64 extend substantially across the width of the system, and define a crescent shaped vacuum zone 66. The squeegee blades 62 and 64 are typically formed from a flexible, elastomeric material such as rubber, plastic, or the like, which can sealingly engage the floor surface.

The forward squeegee blade 62 collects the cleaning solution on the floor surface, and typically includes notches in its floor engaging edge which allows the cleaning solution to enter the vacuum zone 66. The rearward squeegee blade 64 typically has a continuous floor engaging edge in order to prevent the escape of the cleaning solution rearwardly from the vacuum zone 66.

As illustrated in FIGS. 4 and 5, a pair of side disk brooms 68 are rotatably mounted proximal the chassis forward end 38 forward of the ground engaging agitation brushes 56, and are driven by a suitable motor controlled by control circuitry. Each side broom 68 is rotatable about a vertical axis proximal one of the chassis sides 42 and urges debris towards a centerline of the chassis 36 for pick up by a main sweeper broom 69 that is rotatable about a horizontal axis. As illustrated in FIGS. 4 and 5, each side broom 68 extends radially from its vertical axis past one side 42 of the chassis 36 in order to sweep the floor along a wall or other vertical surface. Similar to the squeegee assembly 58, the side brooms 68 may be vertically movable between an operating position and a storage position.

Figure 6:
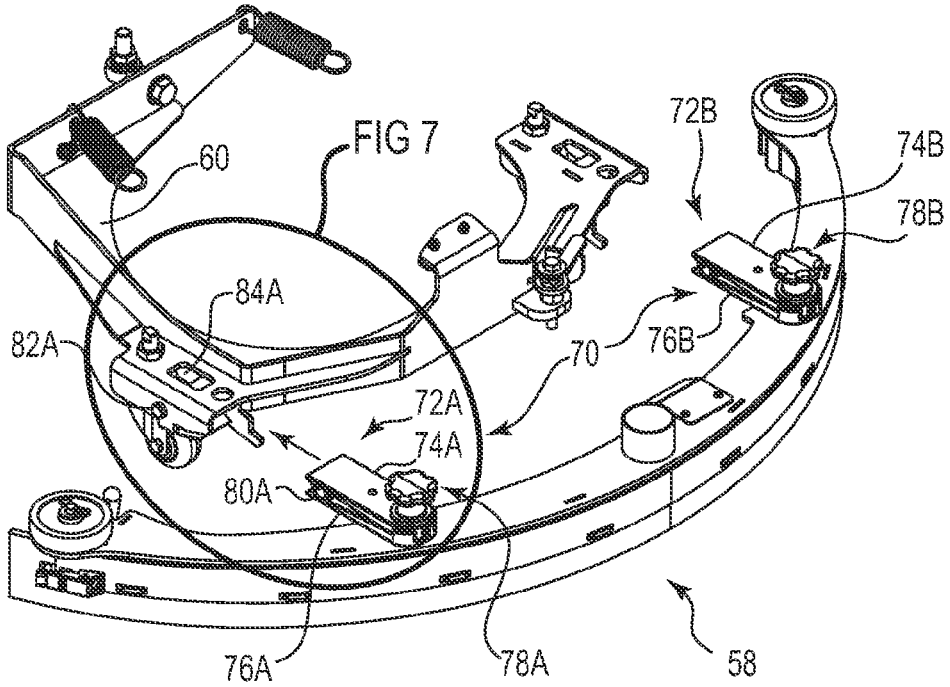
FIG. 6 is a perspective view of the squeegee assembly detached from the squeegee support bracket and illustrating first and second retainer clips in accordance with the present invention.

Now that one exemplary and non-limiting floor cleaning system has been described that may utilize the squeegee retainer clips of the present invention, the structure and operation of the squeegee retainer clips will now be described in detail with reference to FIGS. 6-12. Particularly, FIG. 6 is a perspective view of the squeegee assembly 58 detached from the squeegee support bracket 60 and isolated from the remainder of the sweeper-scrubber 30. As illustrated in FIG. 6, the squeegee assembly 58 is attachable to the squeegee support bracket 60 with a suitable squeegee retainer mechanism 70. In one exemplary embodiment as shown in FIG. 6, the squeegee retainer mechanism 70 includes a first retainer clip 72A having a first or top clip member 74A and a second or bottom clip member 76A, and a second retainer clip 72B having a first or top clip member 74B and a second or bottom clip member 76B. The first retainer clip 72A may be secured to the squeegee assembly 58 with a first locking means 78A while the second retainer clip 72B may be secured to the squeegee assembly 58 with a second locking means 78B.

As those skilled in the art will appreciate, the first and second retainer clips 72A and 72B are identical in both structure and function. Thus, for purposes of simplicity and brevity, the following description will focus on the structure and function of the first retainer clip 72A only. However, it should be understood that the description applies in a similar manner to the second retainer clip 72B of the squeegee retainer mechanism 70.

With further reference to FIG. 6, the first retainer clip 72A is structured such that when the top clip member 74A and bottom clip member 76A are clamped together on top of the squeegee assembly 58 they form a substantially circular shaped opening 80A that is roughly the size of and may be retained onto a pin 82A located in a clip receiving slot 84A on a first side of the squeegee support bracket 60. An enlarged partial perspective view of the first retainer clip 72A adjacent to the clip receiving slot 84A is shown in FIG. 7.

As will be appreciated by those skilled in the art, the first locking means 78A is structured to "clamp" the top and bottom clip members 74A and 76A together, as well as secure the assembled retainer clip 72A to the squeegee assembly 58. The form of the first retainer clip 72A is similar to that of a spring loaded clothes pin or the like. Thus, the top and bottom clip members 74A and 76A are structured to act as spring members and are able to be spread apart, such that they can detach from the pin 82A in the event that the squeegee assembly 58 contacts a fixed object during movement of the machine. The angle formed between the top and bottom clip members 74A and 76A and the pin 82A, along with the spring rate of the clip members, allows for a predictable and repeatable force necessary to extract the retainer clip 74A from the pin 82A (without damage or degradation to either member).

Figure 7:
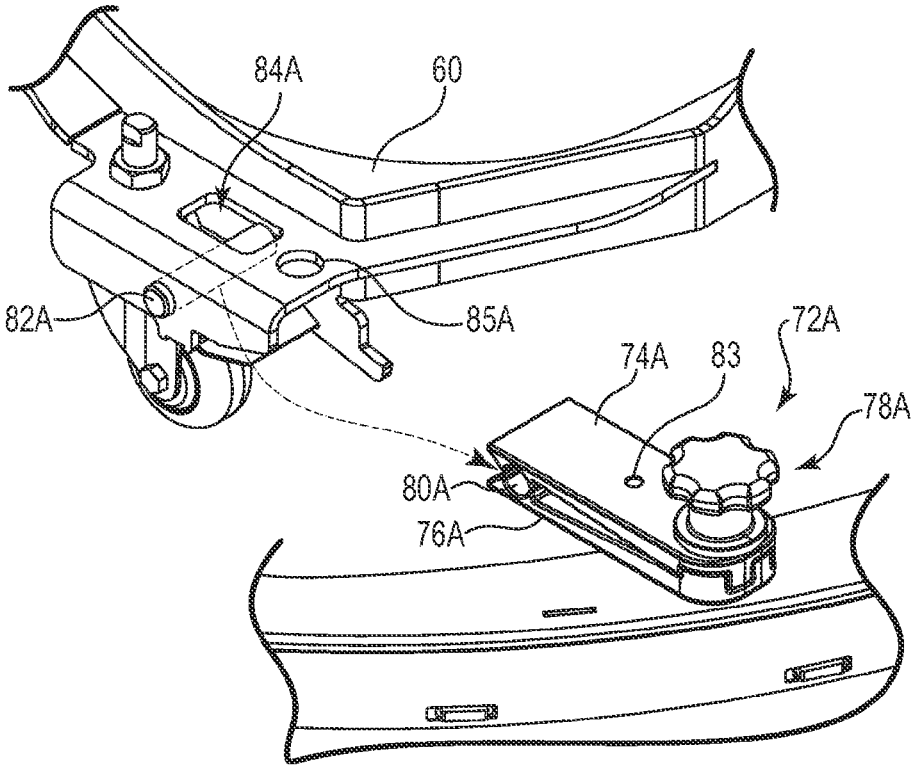
FIG. 7 is an enlarged partial perspective view of the first retainer clip adjacent to a clip receiving slot in the squeegee support bracket.

As illustrated in FIG. 7, the top clip member 74A may include an alignment hole 83 that is visible through an opening 85A in the squeegee support bracket 60 when the first retainer clip 72A is properly positioned within the clip receiving slot 84A. Although not shown, the bottom clip member 76A may include a similar alignment hole. Alternatively, printed markings or other surface features may be used in place of alignment holes that may be visible through the opening 85A in the squeegee support bracket 60 as will be appreciated by those skilled in the art.

Figure 8:
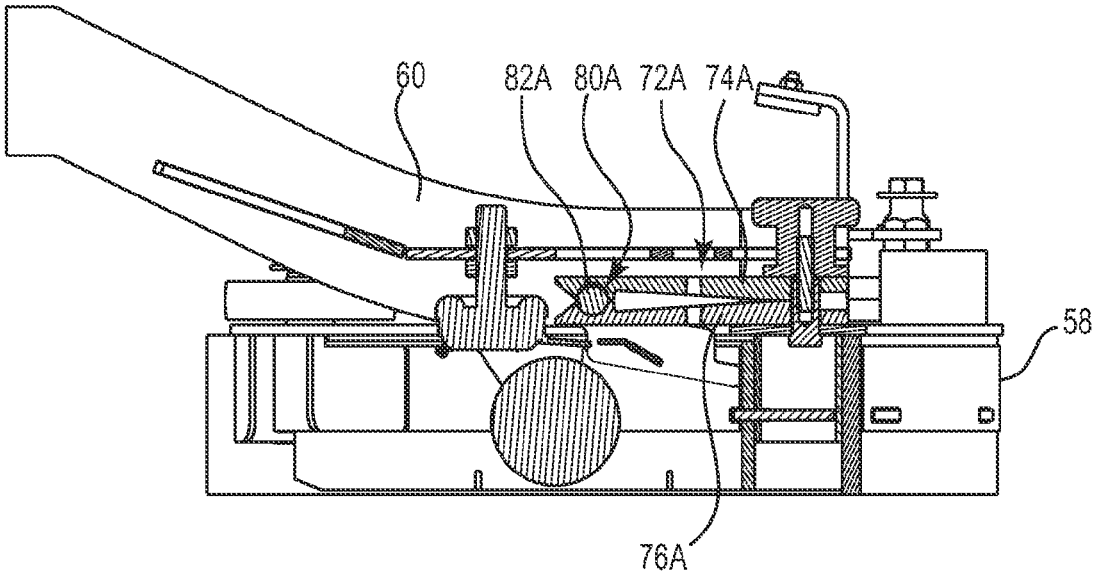
FIG. 8 is a cross-sectional view of the squeegee assembly and squeegee support bracket illustrating the first retainer clip pivotally and releasably coupled to the support bracket.

FIG. 8 is a cross-sectional view of the squeegee assembly 58 and squeegee support bracket 60 illustrating the first retainer clip 72A pivotally and releasably coupled to the circular pin 82A. When coupled as shown in FIG. 8, the circular pin 82A and corresponding circular opening 80A in the retainer clip 72A allow the squeegee assembly 58 to pivot in relation to the squeegee support bracket 60 on the rearward end 40 of the machine chassis 36. This is possible due to the fact that the circular pin 82A has a diameter that is less than a diameter of the opening 80A formed between the top and bottom clip members 74A and 76A.

As will be appreciated by those skilled in the art, alternative embodiments of the retainer clips are contemplated where a pivot is not included in the design. In such embodiments the attaching pin 82A need not be circular and the clip members 74A and 76A need not be stacked on top of one another, only positioned opposite one another to allow for retention onto the squeegee support bracket 60. Thus, alternative embodiments of the pin 82A may be defined by various non-circular cross-sectional shapes such as oval, elliptical, rectangular, or the like without departing from the intended scope of the present invention.

Figure 9:
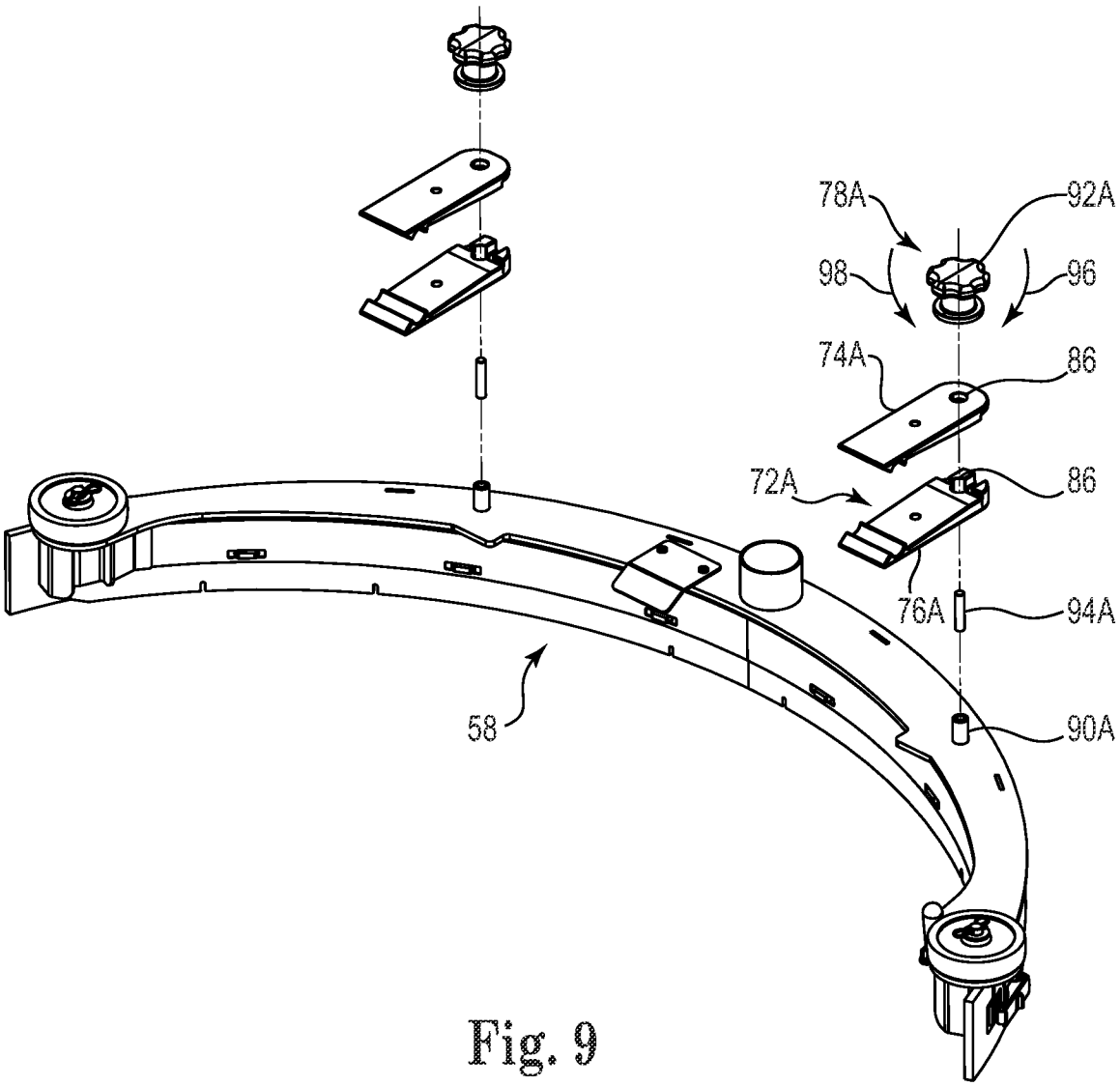
FIG. 9 is a perspective view of the squeegee assembly with the components of the first and second retainer clips exploded so as to illustrate the connection to the squeegee assembly.

FIG. 9 is a perspective view of the squeegee assembly 58 removed from the sweeper-scrubber 30 with the components of the retainer clips exploded so as to illustrate their connection to the squeegee assembly 58. As illustrated in FIG. 9, the top and bottom clip members 74A and 76A of the first retainer clip 72A include apertures 86 that are structured to receive a post member 90A therethrough that extends from a top surface of the squeegee assembly 58. The post member 90A may be designed with an outer diameter that is less than an inner diameter of the apertures 86 so as to allow at least slight rotation of the squeegee assembly 58 relative to the first retainer clip 72A about the post member 90A.

As further illustrated in FIG. 9, the first locking means 78A may be in the form of a rotatable knob 92A having a threaded inner channel (not shown) that is structured to engage with an exteriorly threaded shaft 94A extending from the post member 90A. Thus, turning the rotatable knob 92A in a clockwise direction 96 may result in a tightening of the knob and corresponding clamping force placed upon the top and bottom clip members 74A and 76A. Conversely, turning the rotatable knob 92A in a counterclockwise direction 98 may result in a loosening of the knob and corresponding reduction in the clamping force placed upon the top and bottom clip members 74A and 76A.

The first retainer clip 72A and the first locking means 78A may be designed such that tightening the rotatable knob 92A results in a substantially fixed and repeatable amount of clamping force between the top and bottom clip members 74A and 76A. However, in alternative embodiments, the first retainer clip 72A and the first locking means 78A may be designed such that the amount of clamping force between the top and bottom clip members 74A and 76A depends upon the extent to which the rotatable knob 92A is tightened. In other words, the amount of clamping force may be directly linked to the position of the rotatable knob 92A with respect to the exteriorly threaded shaft 94A.

As will be appreciated by those skilled in the art, a locking means that includes a threaded knob that is engageable with a threaded shaft to tighten the knob is merely one type of locking means that may be used in accordance with the present invention. Thus, any suitable locking means may be used without departing from the intended scope of the present invention including, but not limited to, locking levers, bolts, or the like.

Figure 10A:
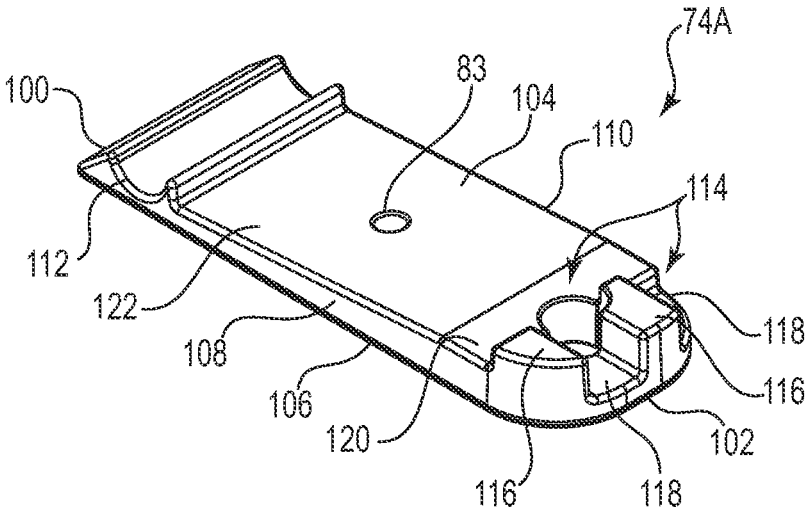
FIGS. 10A-10D illustrate various views of one of the clip member portions.
Figure 10B:
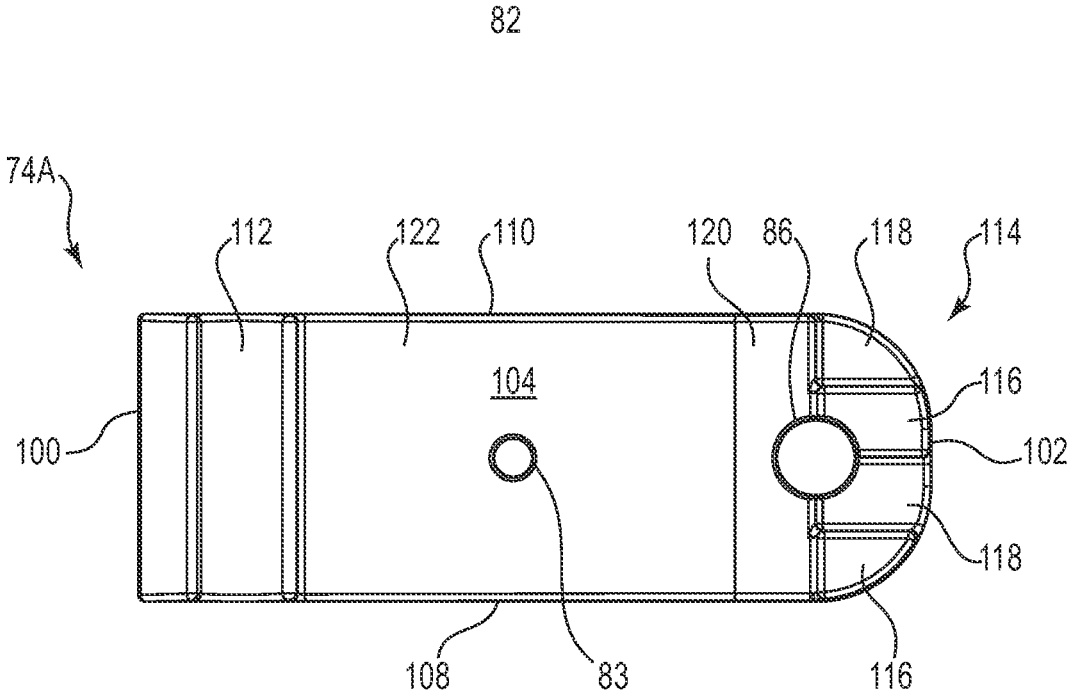
Figure 10C:
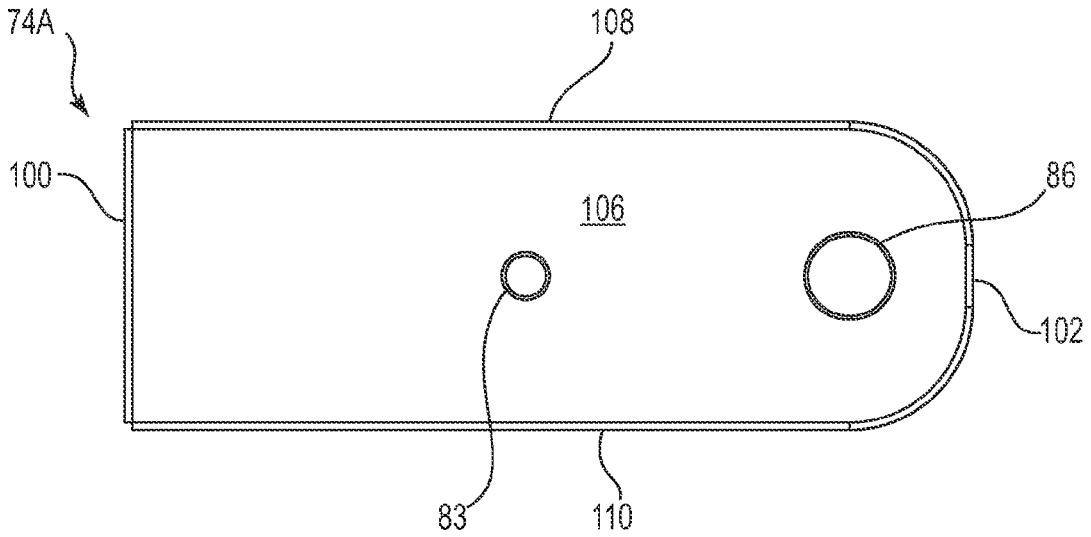
Figure 10D:
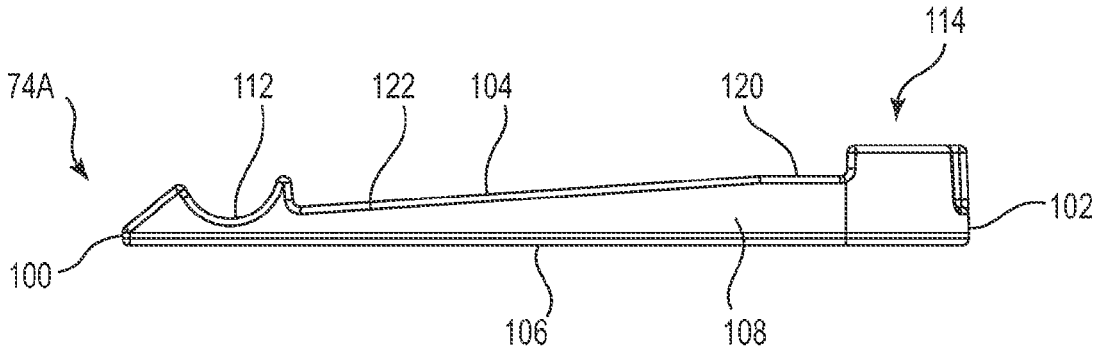

As discussed above, the first retainer clip 72A is formed from two identical clip members, i.e. first clip member 74A and 76A, which are structured to be positioned next to each other in an opposing relationship. The exemplary and non-limiting structure of the clip members that allows for such assembly will now be described with reference to FIGS. 10A-10D. Particularly, FIG. 10A is a perspective view of the top clip member 74A, FIG. 10B is a view illustrating an interior surface of the top clip member 74A, FIG. 10C is a view illustrating an exterior surface of the top clip member 74A, and FIG. 10D is a view illustrating a first side of the top clip member 74A. Although only the top clip member 74A is illustrated, it should be understood that the features and structure of the bottom clip member 76A are identical.

As illustrated in FIGS. 10A-10D, the top clip member 74A includes a forward end 100, a rearward end 102, an interior surface 104, an exterior surface 106, a first side surface 108, and a second side surface 110. Adjacent the forward end 100 on the interior surface 104 is a substantially semicircular channel 112 that forms approximately one-half of the substantially circular shaped opening 80A discussed above for retaining the circular pin 82A. Adjacent the rearward end 102 is an interlocking feature 114 that is defined by at least one protrusion 116 and at least one recess 118. Particularly, the interlocking feature 114 of the top clip member 74A includes a pair of protrusions 116 and a pair of recesses 118. As will be appreciated by those skilled in the art, when assembled as illustrated in FIGS. 6 and 7 the protrusions 116 of the top clip member 74A are structured to be received within and mate with the recesses 118 of the bottom clip member 76A and the protrusions 116 of the bottom clip member 76A are structured to be received within and mate with the recesses 118 of the top clip member 74A. This interlocking structure prevents lateral as well as rotational movement of the top clip member 74A relative to the bottom clip member 76A.

As will be appreciated by those skilled in the art, the interlocking feature 114 of the present invention may utilize any suitable interlocking geometry without departing from the intended scope of the present invention. Thus, protrusions 116 and recesses 118 are described and illustrated merely for purposes of example and not limitation. Alternative interlocking features may comprise, for example, a circular/radial locking mechanism having a plurality of radially extending teeth that are structured to mate with a corresponding plurality of grooves. Numerous such "meshing" designs are possible and within the intended scope of the present invention.

The interior surface 104 of the top clip member 74A may include a substantially flat region 120 and an angled or pitched region 122 disposed between the semicircular channel 112 adjacent the forward end 100 and the interlocking feature 114 adjacent the rearward end. Although not a necessary feature of the top clip member 74A, an angled or pitched region 122 may provide the ability to change the amount of force required to release the pin.

Figure 11:
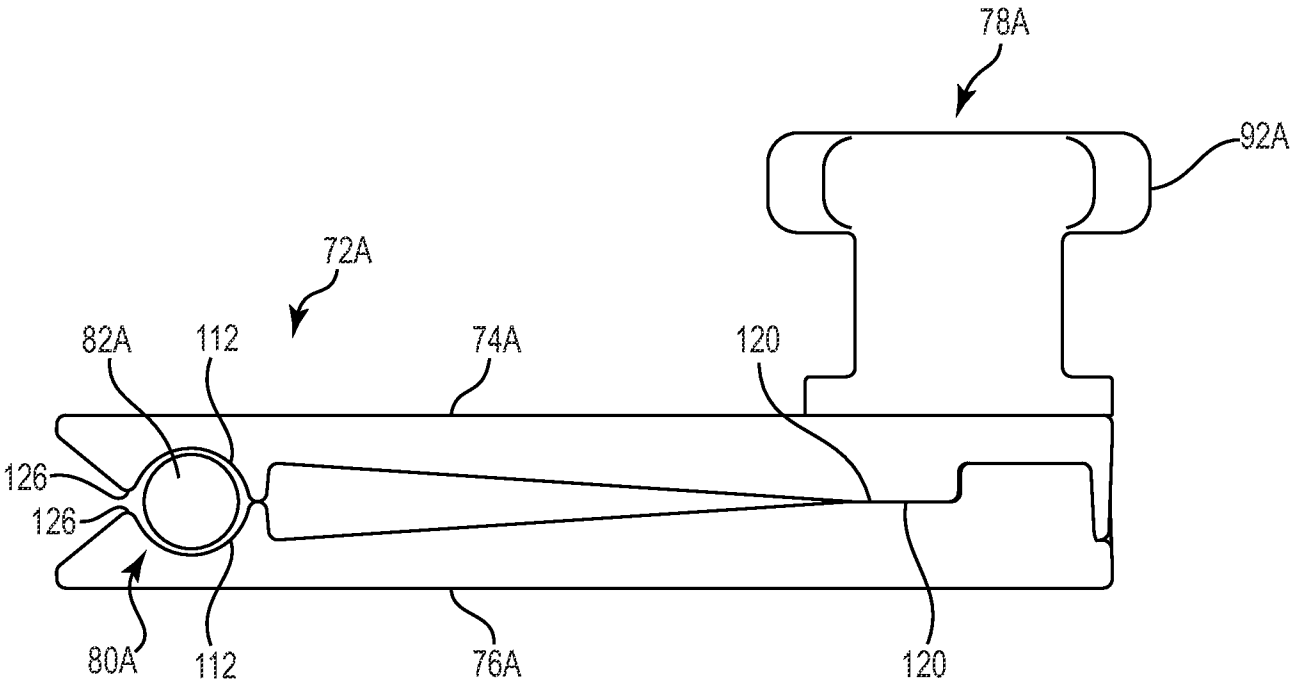
FIG. 11 is a diagram illustrating a side view of the assembled first retainer clip with a circular retaining pin in a corresponding opening in the clip.

FIG. 11 is a diagram illustrating a side view of the assembled first retainer clip 72A with the circular pin 82A of the squeegee support bracket 60 in the circular opening 80A. As illustrated in FIG. 11, the flat regions 120 provide a point of contact between the top and bottom clip members 74A and 76A when mated together. The flat regions 120 also help to stabilize the top and bottom clip members 74A and 76A and distribute the clamping force when the rotatable knob 92A is tightened. As further illustrated in FIG. 11, the semicircular channels 112 of the top and bottom clip members 74A and 76A may each include forward edges 126 that are spaced slightly apart. As will be appreciated by those skilled in the art, the space between the forward edges 126 of the clip members may affect the amount of force required to remove the pin.

Figure 12:
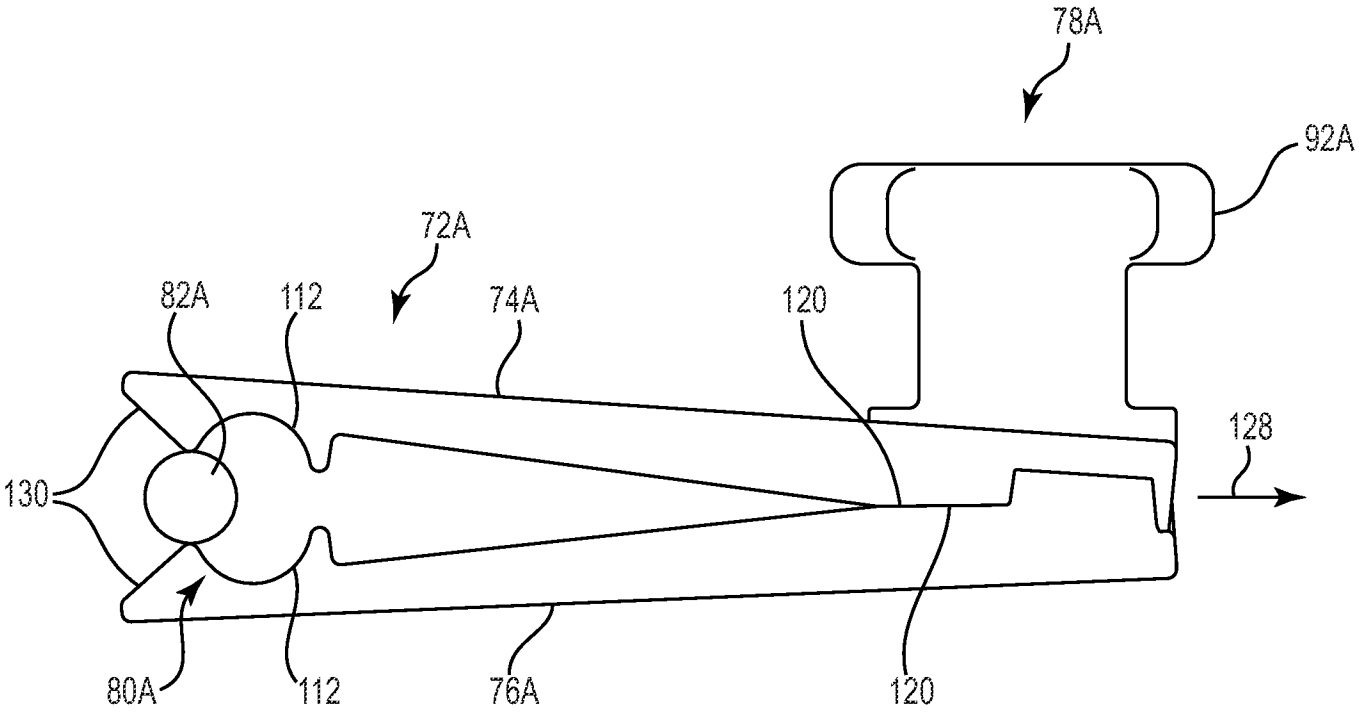
FIG. 12 is a diagram similar to that shown in FIG. 11 illustrating the operation of the first retainer clip.

FIG. 12 is a diagram similar to that shown in FIG. 11 illustrating the first retainer clip 72A being pulled from the circular pin 82A in the direction indicated by arrow 128 due to contact of the squeegee assembly with a fixed obstacle or obstruction. As discussed above, the first retainer clip 72A is structured and designed to require a predictable and repeatable amount of force in order to extract the clip 72A from the pin 82A without damaging either component. One advantage of providing a circular pin 82A and a corresponding circular opening 80A is that as the first retainer clip 72A is being pulled away from the pin 82A, the pin contacts and "rides" up the curved surfaces of the semicircular channels 112. Thus, the circular pin 82A does not get caught up in the opening 80A but instead is guided out of the opening until it is completely released from the clamping force of the retainer clip. As further illustrated in FIG. 12, the forward ends of the first and second clip members 74A and 76A may have beveled edges 130 to assist with guiding the circular pin 82A away from the retainer clip 72A after being released or guiding the pin 82A into the opening.

Although the retainer clips of the present invention have been described herein as being formed by two separate and identical clip members that when stacked on top of one another interlock thereby preventing rotation therebetween, numerous alternative designs are also contemplated. For example, in one exemplary alternative embodiment the retainer clips may be manufactured as a single part that forms both the top and bottom clip members. In another exemplary alternative embodiment, the retainer clips may be formed by separate and non-identical clip members.

Furthermore, retainer clips in accordance with the present invention may be formed from any suitable material including, but not limited to, plastic, hard rubber, metal, or various nylons such as glass filled nylon. Embodiments that are formed from more than one material are also contemplated.

Although the present invention has been described with reference to preferred embodiments, workers skilled in the art will recognize that changes may be made in form and detail without departing from the spirit and scope of the invention.

What is claimed is:

1. A squeegee assembly comprising:

an arcuate vacuumized floor squeegee having a post extending therefrom; and a retainer clip comprising:

a top clip member having an interior surface and an exterior surface, the interior surface including a first channel portion adjacent to a first end;

a bottom clip member having an interior surface and an exterior surface, the interior surface including a second channel portion adjacent to a first end;

a first interlocking feature adjacent to a second end of the top clip member and comprising one or more protrusions and one or more recesses; and a second interlocking feature adjacent to a second end of the bottom clip member and comprising one or more protrusions and one or more recesses, each of the protrusions in the first interlocking feature being structured to mate with a corresponding recess in the second interlocking feature, and each of the protrusions in the second interlocking feature being structured to mate with a corresponding recess in the first interlocking feature;

wherein the first channel portion is structured to be positioned adjacent to the second channel portion to form a pin receiving channel extending along a first axis; and wherein the top and bottom clip members each include an aperture extending along a second axis that is configured to receive the post extending from the arcuate vacuumized floor squeegee, wherein the second axis is generally perpendicular to the first axis.

2. The squeegee assembly of claim 1, wherein the first and second channel portions are each defined by a curved channel surface.

3. The squeegee assembly of claim 2, wherein the curved channel surfaces are semi-circular in shape such that the pin receiving channel has a generally circular cross-section.

4. The squeegee assembly of claim 1, wherein the apertures are substantially circular and define a pivot point to allow the retainer clip to rotate relative to a squeegee assembly.

5. The squeegee assembly of claim 1, further comprising a locking means that is structured to provide a predetermined amount of clamping force upon the top and bottom clip members.

6. The squeegee assembly of claim 5, wherein the locking means comprises a rotatable knob having a threaded inner channel that is structured to engage with an exteriorly threaded shaft that extends through apertures in the top and bottom clip members.

7. The squeegee assembly of claim 1, wherein the top and bottom clip members are formed from a glass reinforced nylon material.

8. A retainer clip for a squeegee assembly, comprising:

a first clip member having an interior surface and an exterior surface, the interior surface including a first curved channel portion adjacent to a first end and a first interlocking feature adjacent to a second end, the first interlocking feature comprising a first protrusion and a first recess; and a second clip member having an interior surface and an exterior surface, the interior surface including a second curved channel portion adjacent to a first end and a second interlocking feature adjacent to a second end, the second interlocking feature comprising a second protrusion structured to be received within the first recess and a second recess structured to receive the first protrusion;

wherein mating the first interlocking feature with the second interlocking feature positions the first channel portion adjacent to the second channel portion to form a pin receiving channel extending along a first axis;

and wherein the first and second clip members each include an aperture extending along a second axis that is configured to receive a post extending from an arcuate vacuumized floor squeegee, wherein the second axis is generally perpendicular to the first axis.

9. The retainer clip of claim 8, wherein the interior surfaces of the first and second clip members are pitched between the first end and the second end.

10. The retainer clip of claim 8, wherein the pin receiving channel has a generally circular cross-section.

11. The retainer clip of claim 8, wherein the first ends of the first and second clip members are beveled.

12. The retainer clip of claim 8, further comprising a locking means that is structured to provide a predetermined amount of clamping force upon the first and second clip members.

13. The retainer clip of claim 12 wherein the locking means comprises a rotatable knob having a threaded inner channel that is structured to engage with an exteriorly threaded shaft that extends through apertures in the first and second clip members.

14. A retainer clip comprising:

a first clip member having an interior surface and an exterior surface, the interior surface including a first channel portion adjacent to a first end and a first interlocking feature adjacent to a second end, the first interlocking feature comprising a first protrusion and a first recess; and a second clip member having an interior surface and an exterior surface, the interior surface including a second channel portion adjacent to a first end and a second interlocking feature adjacent to a second end, the second interlocking feature comprising a second protrusion structured to be received within the first recess and a second recess structured to receive the first protrusion;

wherein the first and second channel portions together define a in receiving channel extending along a first axis;

and wherein the first and second clip members each include an aperture that together define a passage extending along a second axis, wherein the second axis is generally perpendicular to the first axis.

15. The retainer clip of claim 14, wherein the first and second clip members are formed integral with one another.

16. The retainer clip of claim 14, wherein the first and second clip members are separable from one another.

* * * * *